US010565969B1

(12) United States Patent
Gregory

(10) Patent No.: US 10,565,969 B1
(45) Date of Patent: Feb. 18, 2020

(54) CYMBAL DAMPENING SYSTEM

(71) Applicant: Jonathan Blake Gregory, Brier, WA (US)

(72) Inventor: Jonathan Blake Gregory, Brier, WA (US)

( * ) Notice: Subject to any disclaimer, the term of this patent is extended or adjusted under 35 U.S.C. 154(b) by 0 days.

(21) Appl. No.: 16/366,358

(22) Filed: Mar. 27, 2019

Related U.S. Application Data

(60) Provisional application No. 62/649,074, filed on Mar. 28, 2018.

(51) Int. Cl.
*G10D 13/08* (2006.01)
*G10D 13/06* (2020.01)

(52) U.S. Cl.
CPC ..... *G10D 13/06* (2013.01)

(58) Field of Classification Search
CPC ..... G10D 13/06
USPC ..... 84/402
See application file for complete search history.

(56) References Cited

U.S. PATENT DOCUMENTS

| | | | | |
|---|---|---|---|---|
| 6,686,528 | B1 * | 2/2004 | Dicken | G10D 13/06 84/422.1 |
| 6,720,491 | B1 * | 4/2004 | Kroncke | G10D 13/06 84/422.3 |
| 7,368,649 | B2 * | 5/2008 | Mintz | G10D 13/06 84/402 |
| 10,079,008 | B2 * | 9/2018 | Suitor | G10H 3/146 |
| 2014/0298978 | A1 * | 10/2014 | Yoshino | G10H 1/32 84/743 |

* cited by examiner

*Primary Examiner* — Jianchun Qin
(74) *Attorney, Agent, or Firm* — Plager Schack LLP; Mark H. Plager; Michael J. O'Brien

(57) ABSTRACT

A cymbal dampening system is configured to alter sound vibration of a cymbal. The cymbal dampening system has a first dampening bracket joined to a first wrap having a first pad that is adjacent to the cymbal. A second dampening bracket is joined to the first dampening bracket and a third dampening bracket with a cord. The second dampening bracket is joined to a second wrap having a second pad that is adjacent to the cymbal. The third dampening bracket is joined to a third wrap having a third pad that is adjacent to the cymbal. The first pad, the second pad and the third pad operate to alter sound vibration of the cymbal when struck.

5 Claims, 4 Drawing Sheets

CYMBAL DAMPENING SYSTEM

RELATED APPLICATION

This application claims priority to provisional patent application U.S. Ser. No. 62/649,074 filed on Mar. 28, 2018, the entire contents of which is herein incorporated by reference.

BACKGROUND

The embodiments herein relate generally to musical instruments and accessories, Prior to embodiments of the disclosed invention there was no effective cymbal dampening system. Embodiments of the disclosed invention solve this problem.

SUMMARY

A cymbal dampening system is configured to alter sound vibration of a cymbal. The cymbal dampening system has a first dampening bracket joined to a first wrap having a first pad that is adjacent to the cymbal. A second dampening bracket is joined to the first dampening bracket and a third dampening bracket with a cord. The second dampening bracket is joined to a second wrap having a second pad that is adjacent to the cymbal. The third dampening bracket is joined to a third wrap having a third pad that is adjacent to the cymbal. The first pad, the second pad and the third pad operate to alter sound vibration of the cymbal when struck

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
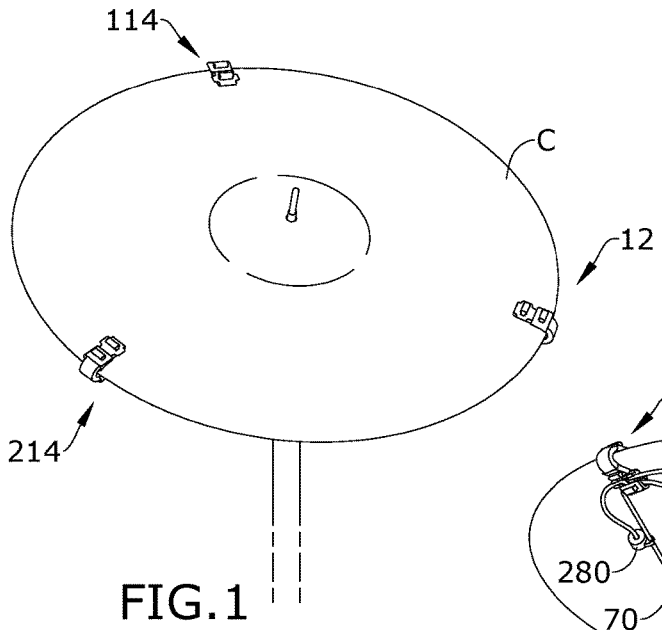
FIG. 1 shows top perspective view of one embodiment of the present invention.
Figure 2:
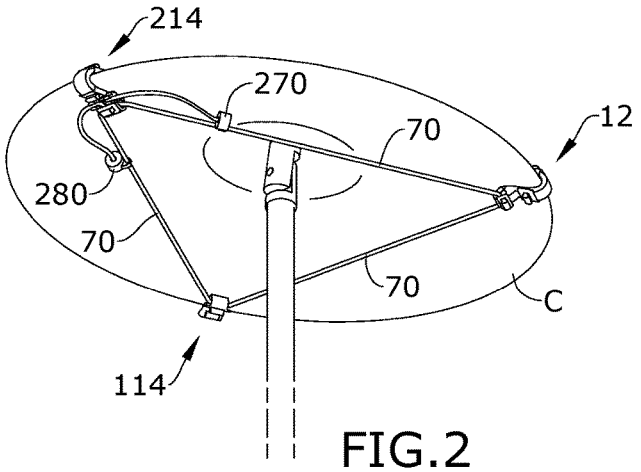
FIG. 2 shows a bottom perspective view of one embodiment of the present invention.
Figure 3:
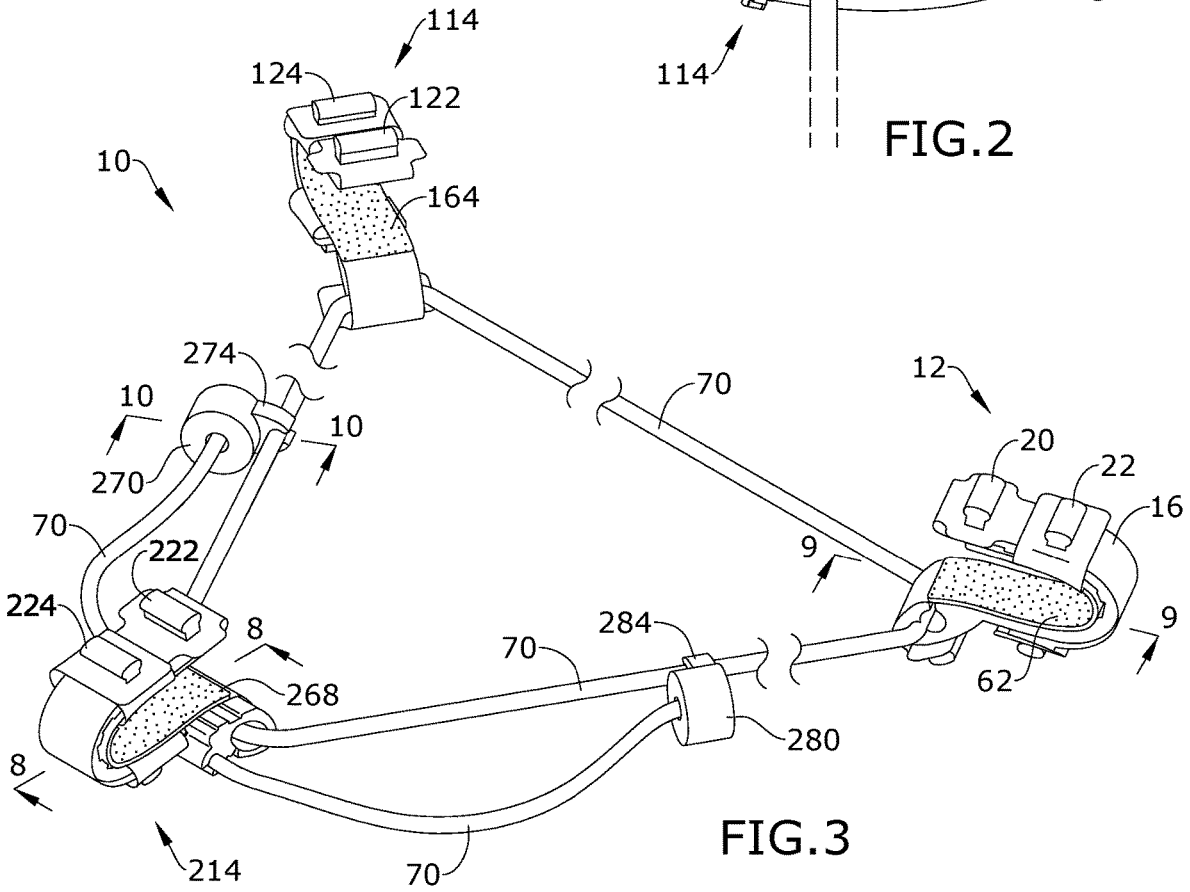
FIG. 3 shows a top perspective view of one embodiment of the present invention.
Figure 4:
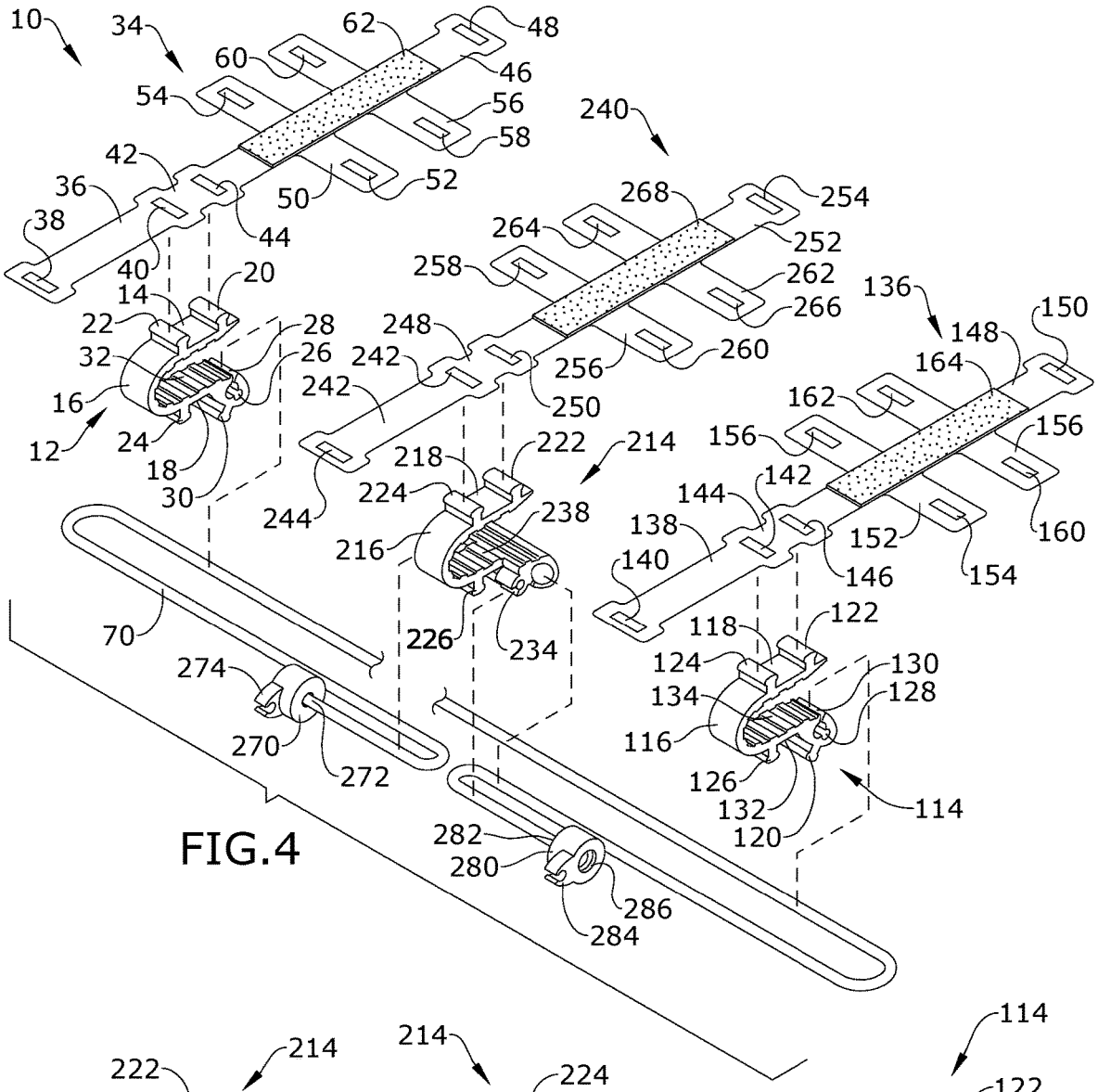
FIG. 4 shows an exploded view of one embodiment of the present invention.
Figure 5:
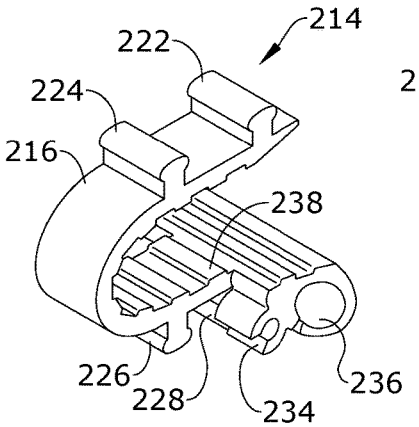
FIG. 5 shows a top detail view of one embodiment of the present invention.
Figure 6:
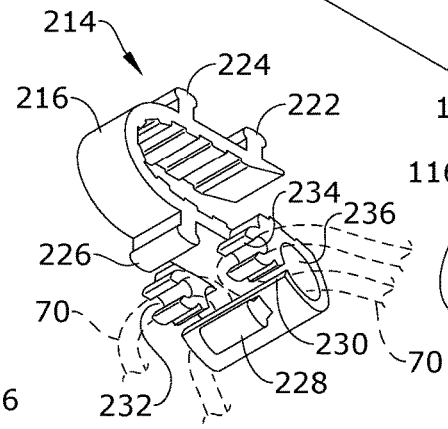
FIG. 6 shows a bottom detail perspective view of one embodiment of the present invention.
Figure 7:
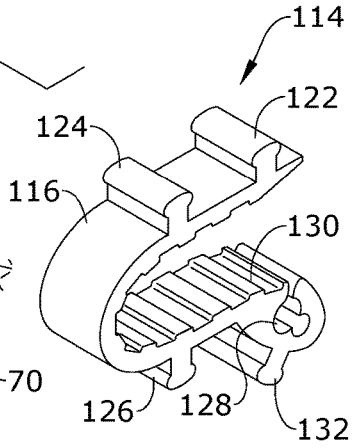
FIG. 7 shows a detail perspective view of one embodiment of the present invention.
Figure 8:
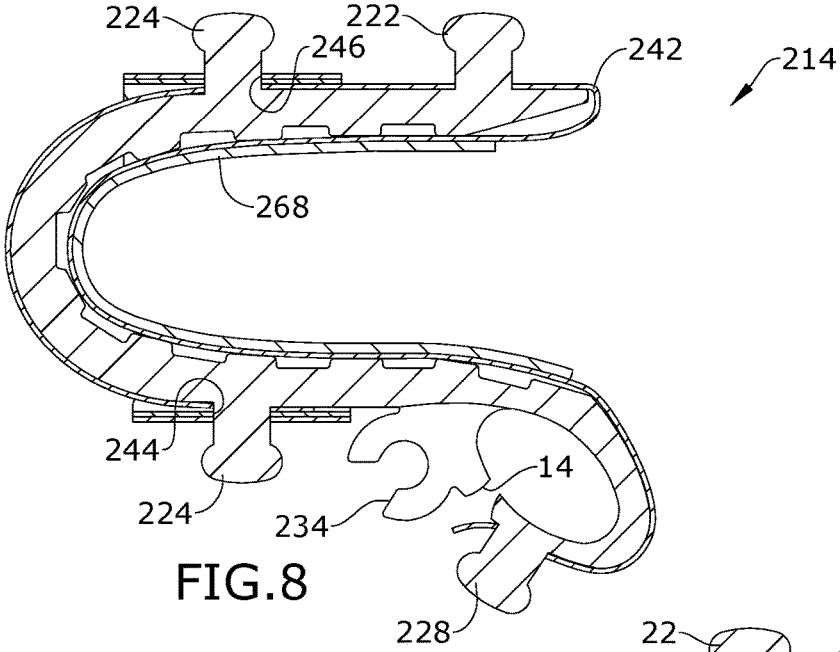
FIG. 8 shows section view of one embodiment of the present invention taken along line 8-8 in FIG. 3.
Figure 9:
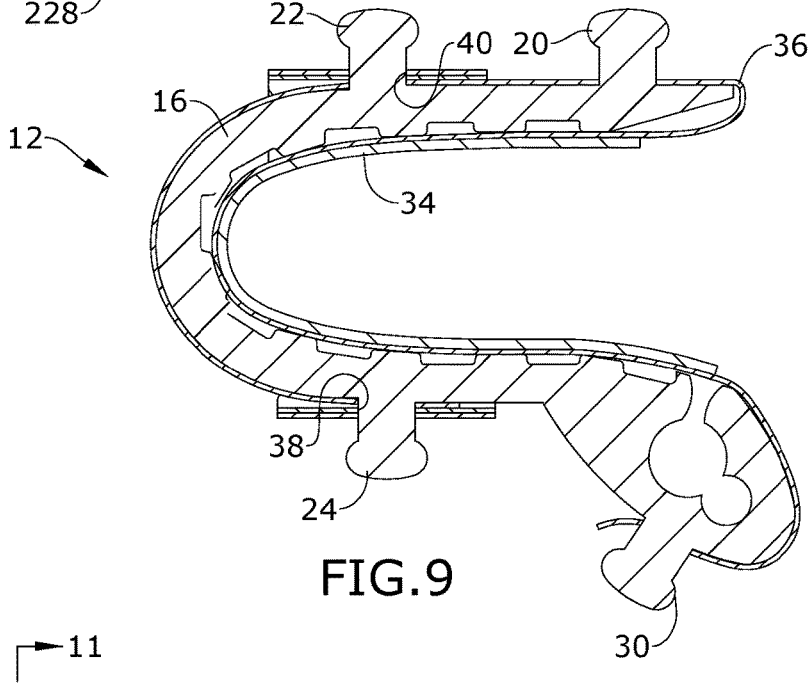
FIG. 9 shows section view of one embodiment of the present invention taken along line 9-9 in FIG. 3.
Figure 10:
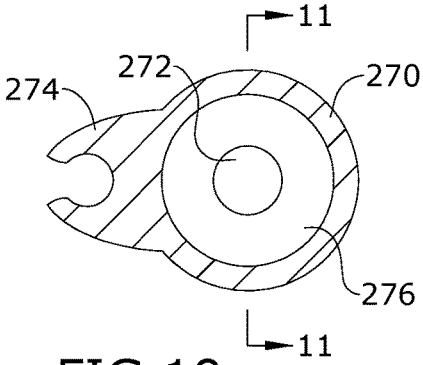
FIG. 10 shows section view of one embodiment of the present invention taken along line 10-10 in FIG. 3.
Figure 11:
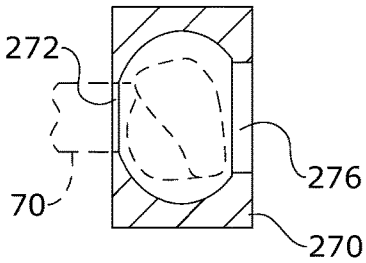
FIG. 11 shows section view of one embodiment of the present invention taken along line 11-11 in FIG. 10.
Figure 12:
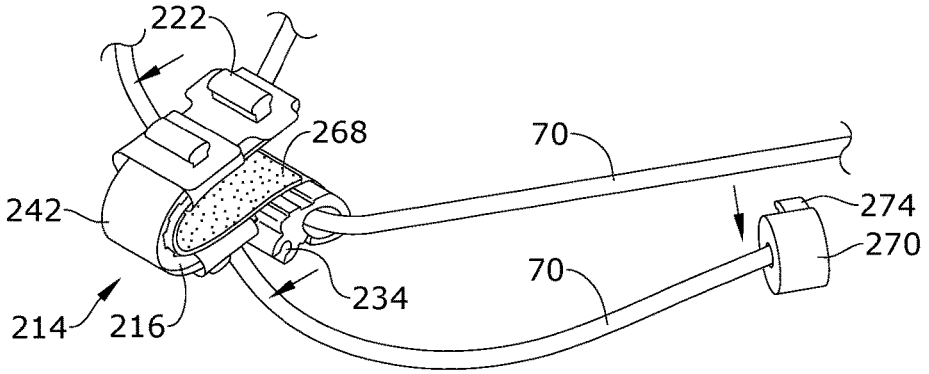
FIG. 12 shows a detail perspective view of one embodiment of the present invention.
Figure 13:
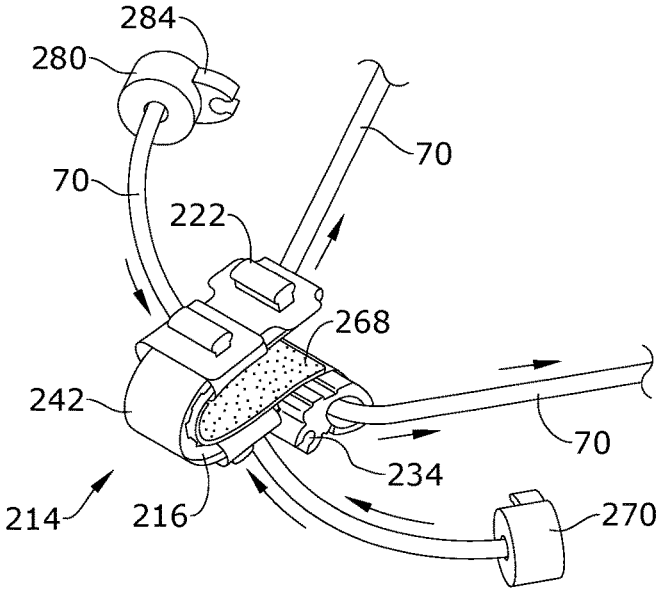
FIG. 13 shows a detail perspective view of one embodiment of the present invention.
Figure 14:
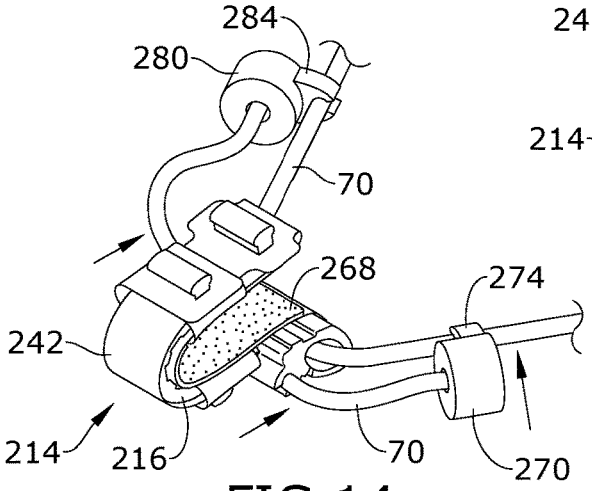
FIG. 14 shows a detail perspective view of one embodiment of the present invention.
Figure 15:
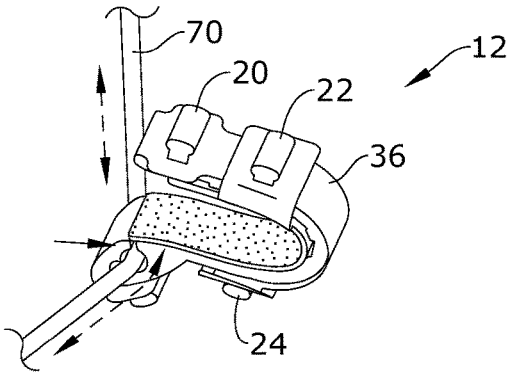
FIG. 15 shows a detail perspective view of one embodiment of the present invention.

By way of example, and referring to FIGS. 1-15, one embodiment of a cymbal dampening system 10 is configured to alter sound vibration of a cymbal C. The cymbal dampening system 10 comprises a first dampening bracket 12.

The first dampening bracket 12 further comprises a first dampening bracket central portion 14 joined to a first dampening bracket upper portion 16 and a first dampening bracket lower portion 18. A first dampening bracket first outward protrusion 20 and a first dampening bracket second outward protrusion 22 extend from the first dampening bracket upper portion 16. A first dampening bracket third outward protrusion 24 extends from the first dampening bracket lower portion 18. A first dampening bracket cord travel protrusion 26 extends from a first dampening bracket lower portion distal end 28. A first dampening bracket cord travel protrusion outward protrusion 30 extends from the first dampening bracket cord travel protrusion 26. A plurality of first dampening bracket inward protrusions 32 is arranged on the first dampening bracket central portion 14, the first dampening bracket upper portion 16, and the first dampening bracket lower portion 18.

A first wrap 34 further comprises a first wrap first segment 36 joined to a first wrap first opening portion 38 and a first wrap second opening portion 40. The first wrap first opening portion 38 fits around the first dampening bracket third outward protrusion 24. The first wrap second opening portion 40 fits around the first dampening bracket second outward protrusion 22. A first wrap second segment 42 is joined to the first wrap second opening portion 40 and to a first wrap third opening portion 44. The first wrap third opening portion 44 fits around the first dampening bracket first outward protrusion 20. A first wrap third segment 46 joined to the first wrap third opening portion 44 and a first wrap fourth opening position 48. The first wrap fourth opening position 48 fits around the first dampening bracket cord travel protrusion outward protrusion 30. A first wrap first cross member 50 is joined perpendicular to the first wrap third segment 46 and further comprising a first wrap first cross member first opening portion 52 and a first wrap first cross member second opening portion 54. The first wrap first cross member first opening portion 52 and the first wrap first cross member second opening portion 54 fit over the first dampening bracket second outward protrusion 22.

A first wrap second cross member 56 is joined perpendicular to the first wrap third segment 46 further comprises a first wrap second cross member first opening portion 58 and a first wrap second cross member second opening portion 60. The first wrap second cross member first opening portion 58 and the first wrap second cross member second opening portion 60 fit over the first dampening bracket third outward protrusion 24. A first pad 62 is attached to the first wrap third segment 46 and extends over the plurality of first dampening bracket inward protrusions 32. The first pad 62 is immediately adjacent to the cymbal C and alters the sound of the cymbal C when the cymbal C is struck.

The cymbal dampening system 10 further comprises a second dampening bracket 114 joined to the first dampening bracket 12 with a cord 70 through the second dampening bracket cord travel protrusion 26. The second dampening bracket 114 comprises a second dampening bracket central portion 116 joined to a second dampening bracket upper portion 118 and a second dampening bracket lower portion 120. A second dampening bracket first outward protrusion 122 and a second dampening bracket second outward protrusion 124 extend from the second dampening bracket upper portion 118. A second dampening bracket third outward protrusion 126 extends from the second dampening bracket lower portion 120. A second dampening bracket cord travel protrusion 128, extends from a second dampening bracket lower portion distal end 130. A second dampening bracket cord travel protrusion outward protrusion 132 extends from the second dampening bracket cord travel protrusion 128. A plurality of second dampening bracket inward protrusions 134 is arranged on the second dampening bracket central portion 116, the second dampening bracket upper portion 118 and the second dampening bracket lower portion 120.

A second wrap 136 further comprises a second wrap first segment 138 joined to a second wrap first opening portion 140 and a second wrap second opening portion 142. The second wrap first opening portion 140 fits around the second dampening bracket third outward protrusion 126. The second wrap second opening portion 142 fits around the second dampening bracket second outward protrusion 124. A second wrap second segment 144 is joined to the second wrap second opening portion 142 and to a second wrap third opening portion 146. The second wrap third opening portion 146 fits around the second dampening bracket first outward protrusion 122. A second wrap third segment 148 is joined to the second wrap third opening portion 146 and a second wrap fourth opening position 150. The second wrap fourth opening position 150 fits around the second dampening bracket cord travel protrusion outward protrusion 132. A second wrap first cross member 152 is joined perpendicular to the second wrap third segment 148 and further comprises a second wrap first cross member first opening portion 154 and a second wrap first cross member second opening portion 156. The second wrap first cross member first opening portion 154 and the second wrap first cross member second opening portion 156 fit over the second dampening bracket second outward protrusion 124.

A second wrap second cross member 158 is joined perpendicular to the second wrap third segment 148 and further comprises a second wrap second cross member first opening portion 160 and a second wrap second cross member second opening portion 162. The second wrap second cross member first opening portion 160 and the second wrap second cross member second opening portion 162 fit over the second dampening bracket third outward protrusion 126. A second pad 164 is attached to the second wrap third segment 148 and extends over the plurality of second dampening bracket inward protrusions 134. The second pad 164 is immediately adjacent to the cymbal C and alters the sound of the cymbal C when the cymbal C is struck.

The cymbal dampening system 10 further comprises a third dampening bracket 214 joined to the first dampening bracket 12 and the second dampening bracket 114 with the cord 70 through the first dampening bracket cord travel protrusion 26 and the second dampening bracket cord travel protrusion 128. The third dampening bracket 214 comprises a third dampening bracket central portion 216 joined to a first dampening bracket upper portion 218 and a third dampening bracket lower portion 220. A third dampening bracket first outward protrusion 222 and a third dampening bracket second outward protrusion 224 extend from the first dampening bracket upper portion 218. A third dampening bracket third outward protrusion 226 extends from the third dampening bracket lower portion 220. A third dampening bracket cord travel protrusion 228 extends from a third dampening bracket lower portion distal end 230. A third dampening bracket cord travel protrusion outward protrusion 232 extends from the third dampening bracket cord travel protrusion 228. A third dampening bracket cord travel protrusion first cord lock insertion slot 234 extends from the third dampening bracket cord travel protrusion 228. A third dampening bracket cord travel protrusion second cord lock insertion slot 236 extends from the third dampening bracket cord travel protrusion 228. A plurality of third dampening bracket inward protrusions 238 is arranged on the third dampening bracket central portion 216, the third dampening bracket upper portion 218 and the third dampening bracket lower portion 220.

A third wrap 240 further comprises a third wrap first segment 242 joined to a third wrap first opening portion 244 and a third wrap second opening portion 246, The third wrap first opening portion 244 fits around the third dampening bracket third outward protrusion 226. The third wrap second opening portion 246 fits around the third dampening bracket second outward protrusion 224. A third wrap second segment 248 is joined to the third wrap second opening portion 246 and to a third wrap third opening portion 250. The third wrap third opening portion 250 fits around the third dampening bracket first outward protrusion 222. A third wrap third segment 252 is joined to the third wrap third opening portion 250 and a third wrap fourth opening position 254. The third wrap fourth opening position 254 fits around the third dampening bracket cord travel protrusion outward protrusion 232. A third wrap first cross member 256 is joined perpendicular to the third wrap third segment 252 and further comprises a third wrap first cross member first opening portion 258 and a third wrap first cross member second opening portion 260. The third wrap first cross member first opening portion 258 and the third wrap first cross member second opening portion 260 fit over the third dampening bracket second outward protrusion 224.

A third wrap second cross member 262 is joined perpendicular to the third wrap third segment 252 and further comprises a third wrap second cross member first opening portion 264 and a third wrap second cross member second opening portion 266. The third wrap second cross member first opening portion 264 and the third wrap second cross member second opening portion 266 fit over the third dampening bracket third outward protrusion 226. A third pad 268 is attached to the third wrap third segment 252 and extending over the plurality of third dampening bracket inward protrusions 238. The third pad 268 is immediately adjacent to the cymbal C and alters the sound of the cymbal C when the cymbal C is struck.

A first cord cap 270 is joined to a first cord end 272 and further comprises a first cord cap clip 274 and a first cord cap opening 276. A second cord cap 280 is joined to a second cord end 282 and further comprises a second cord cap clip 284 and a second cord cap opening 286.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A cymbal dampening system, configured to alter sound vibration of a cymbal, the cymbal dampening system comprising:

a first dampening bracket, further comprising a first dampening bracket central portion joined to a first dampening bracket upper portion and a first dampening bracket lower portion;

a first dampening bracket first outward protrusion and a first dampening bracket second outward protrusion extending from the first dampening bracket upper portion;

a first dampening bracket third outward protrusion, extending from the first dampening bracket lower portion;

a first dampening bracket cord travel protrusion, extending from a first dampening bracket lower portion distal end;

a first dampening bracket cord travel protrusion outward protrusion, extending from the first dampening bracket cord travel protrusion;

a plurality of first dampening bracket inward protrusions, arranged on the first dampening bracket central portion, the first dampening bracket upper portion and the first dampening bracket lower portion;

a first wrap further comprising:

a first wrap first segment joined to a first wrap first opening portion and a first wrap second opening portion; wherein the first wrap first opening portion fits around the first dampening bracket third outward protrusion; wherein the first wrap second opening portion fits around the first dampening bracket second outward protrusion;

a first wrap second segment joined to the first wrap second opening portion and to a first wrap third opening portion; wherein the first wrap third opening portion fits around the first dampening bracket first outward protrusion;

a first wrap third segment; joined to the first wrap third opening portion and a first wrap fourth opening position; wherein the first wrap fourth opening position fits around the first dampening bracket cord travel protrusion outward protrusion;

a first wrap first cross member, joined perpendicular to the first wrap third segment and further comprising a first wrap first cross member first opening portion and a first wrap first cross member second opening portion; wherein the first wrap first cross member first opening portion and the first wrap first cross member second opening portion fit over the first dampening bracket second outward protrusion;

a first wrap second cross member, joined perpendicular to the first wrap third segment and further comprising a first wrap second cross member first opening portion and a first wrap second cross member second opening portion; wherein the first wrap second cross member first opening portion and the first wrap second cross member second opening portion fit over the first dampening bracket third outward protrusion;

a first pad attached to the first wrap third segment and extending over the plurality of first dampening bracket inward protrusions;

wherein the first pad is immediately adjacent to the cymbal and alters the sound of the cymbal when the cymbal is struck.

2. The cymbal dampening system of claim 1, further comprising:

a second dampening bracket, joined to the first dampening bracket with a cord through the first dampening bracket cord travel protrusion; the second dampening bracket comprising:

a second dampening bracket central portion joined to a second dampening bracket upper portion and a second dampening bracket lower portion;

a second dampening bracket first outward protrusion and a second dampening bracket second outward protrusion extending from the second dampening bracket upper portion;

a second dampening bracket third outward protrusion, extending from the second dampening bracket lower portion;

a second dampening bracket cord travel protrusion, extending from a second dampening bracket lower portion distal end;

a second dampening bracket cord travel protrusion outward protrusion, extending from the second dampening bracket cord travel protrusion;

a plurality of second dampening bracket inward protrusions, arranged on the second dampening bracket central portion, the second dampening bracket upper portion and the second dampening bracket lower portion;

a second wrap further comprising:

a second wrap first segment joined to a second wrap first opening portion and a second wrap second opening portion; wherein the second wrap first opening portion fits around the second dampening bracket third outward protrusion; wherein the second wrap second opening portion fits around the second dampening bracket second outward protrusion;

a second wrap second segment joined to the second wrap second opening portion and to a second wrap third opening portion; wherein the second wrap third opening portion fits around the second dampening bracket first outward protrusion;

a second wrap third segment, joined to the second wrap third opening portion and a second wrap fourth opening position; wherein the second wrap fourth opening position fits around the second dampening bracket cord travel protrusion outward protrusion;

a second wrap first cross member, joined perpendicular to the second wrap third segment and further comprising a second wrap first cross member first opening portion and a second wrap first cross member second opening portion; wherein the second wrap first cross member first opening portion and the second wrap first cross member second opening portion fit over the second dampening bracket second outward protrusion;

a second wrap second cross member, joined perpendicular to the second wrap third segment and further comprising a second wrap second cross member first opening portion and a second wrap second cross member second opening portion; wherein the second wrap second cross member first opening portion and the second wrap second cross member second opening portion fit over the second dampening bracket third outward protrusion;

a second pad attached to the second wrap third segment and extending over the plurality of second dampening bracket inward protrusions;

wherein the second pad is immediately adjacent to the cymbal and alters the sound of the cymbal when the cymbal is struck.

3. The cymbal dampening system of claim 2, further comprising:

a third dampening bracket, joined to the first dampening bracket and the second dampening bracket with the cord through the first dampening bracket cord travel protrusion and the second dampening bracket cord travel protrusion; the third dampening bracket comprising:

a third dampening bracket central portion joined to a first dampening bracket upper portion and a third dampening bracket lower portion;

a third dampening bracket first outward protrusion and a third dampening bracket second outward protrusion extending from the first dampening bracket upper portion;

a third dampening bracket third outward protrusion, extending from the third dampening bracket lower portion;

a third dampening bracket cord travel protrusion, extending from a third dampening bracket lower portion distal end;

a third dampening bracket cord travel protrusion outward protrusion, extending from the third dampening bracket cord travel protrusion;

a third dampening bracket cord travel protrusion first cord lock insertion slot, extending from the third dampening bracket cord travel protrusion;

a third dampening bracket cord travel protrusion second cord lock insertion slot, extending from the third dampening bracket cord travel protrusion;

a plurality of third dampening bracket inward protrusions, arranged on the third dampening bracket central portion, the first dampening bracket upper portion and the third dampening bracket lower portion;

a third wrap further comprising:

a third wrap first segment joined to a third wrap first opening portion and a third wrap second opening portion; wherein the third wrap first opening portion fits around the third dampening bracket third outward protrusion; wherein the third wrap second opening portion fits around the third dampening bracket second outward protrusion;

a third wrap second segment joined to the third wrap second opening portion and to a third wrap third opening portion; wherein the third wrap third opening portion fits around the third dampening bracket first outward protrusion;

a third wrap third segment, joined to the third wrap third opening portion and a third wrap fourth opening position; wherein the third wrap fourth opening position fits around the third dampening bracket cord travel protrusion outward protrusion;

a third wrap first cross member, joined perpendicular to the third wrap third segment and further comprising a third wrap first cross member first opening portion and a third wrap first cross member second opening portion; wherein the third wrap first cross member first opening portion and the third wrap first cross member second opening portion fit over the third dampening bracket second outward protrusion;

a third wrap second cross member, joined perpendicular to the third wrap third segment and further comprising a third wrap second cross member first opening portion and a third wrap second cross member second opening portion; wherein the third wrap second cross member first opening portion and the third wrap second cross member second opening portion fit over the third dampening bracket third outward protrusion;

a second pad attached to the third wrap third segment and extending over the plurality of third dampening bracket inward protrusions;

wherein the second pad is immediately adjacent to the cymbal and alters the sound of the cymbal when the cymbal is struck.

4. The cymbal dampening system of claim 3, further comprising: a first cord cap, joined to a first cord end and further comprising a first cord cap clip and a first cord cap opening.

5. The cymbal dampening system of claim 4, further comprising: a second cord cap, joined to a second cord end and further comprising a second cord cap clip and a second cord cap opening.

* * * * *